US012644678B2

(12) United States Patent
Liao

(10) Patent No.: US 12,644,678 B2
(45) Date of Patent: Jun. 2, 2026

(54) ELECTRONIC TARGET WITH MEMS SENSOR

(71) Applicant: GUAY GUAY TRADING CO., LTD., Changhua County (TW)

(72) Inventor: Yin-Hsi Liao, Changhua County (TW)

(73) Assignee: GUAY GUAY TRADING CO., LTD., Changhua County (TW)

( * ) Notice: Subject to any disclaimer, the term of this patent is extended or adjusted under 35 U.S.C. 154(b) by 328 days.

(21) Appl. No.: 18/110,888

(22) Filed: Feb. 17, 2023

(65) Prior Publication Data

US 2024/0118060 A1 Apr. 11, 2024

(30) Foreign Application Priority Data

Oct. 5, 2022 (TW) ..... 111210891

(51) Int. Cl.

| | |
|---|---|
| ***F41J 5/00*** | (2006.01) |
| ***A63F 7/20*** | (2006.01) |
| ***F41J 5/056*** | (2006.01) |
| *F41J 5/02* | (2006.01) |

(52) U.S. Cl.

CPC ..... *F41J 5/056* (2013.01); *A63F 7/20* (2013.01); *F41J 5/02* (2013.01)

(58) Field of Classification Search

None

See application file for complete search history.

(56) References Cited

U.S. PATENT DOCUMENTS

| | | | | |
|---|---|---|---|---|
| 2,916,289 | A * | 12/1959 | Zito | F41J 5/06 346/139 R |
| 5,716,302 | A * | 2/1998 | Andersson | A63B 69/34 482/84 |
| 8,105,087 | B2 * | 1/2012 | Valentini | F41J 5/056 434/11 |
| 8,523,185 | B1 * | 9/2013 | Gilbreath | F41J 5/14 434/23 |
| 9,429,397 | B1 * | 8/2016 | Hill | F41J 5/06 |
| 11,131,529 | B2 * | 9/2021 | Brockel | F41J 5/14 |
| 2003/0091960 | A1 * | 5/2003 | Rosa | F41J 7/04 434/21 |
| 2003/0134700 | A1 * | 7/2003 | Salva | F41J 13/02 473/476 |
| 2005/0153262 | A1 * | 7/2005 | Kendir | F41G 3/2655 434/21 |
| 2015/0247709 | A1 * | 9/2015 | Roberts | F41J 5/04 340/540 |
| 2016/0370156 | A1 * | 12/2016 | Elizondo | F41J 5/056 |

* cited by examiner

*Primary Examiner* — Sunit Pandya

(74) *Attorney, Agent, or Firm* — Birch, Stewart, Kolasch & Birch, LLP

(57) ABSTRACT

The electronic target includes a front plate, a chamber behind the front plate, a MEMS (Micro Electro Mechanical Systems) sensor element inside the chamber joined to the front plate by at least a connection element, a main control device electrically connected to the MEMS sensor element, and a signal processing element electrically connected to the MEMS sensor element and the main control device. Due to the MEMS sensor element's small dimension, light weight, low power consumption, high durability, low cost, and stable performance, it can be integrated into the electronic target simply by the connection element without being constrained by its shape and size, and the electronic target can be installed more conveniently and quickly.

6 Claims, 9 Drawing Sheets

ELECTRONIC TARGET WITH MEMS SENSOR

BACKGROUND OF THE INVENTION

(a) Technical Field of the Invention

The present invention is generally related to electronic targets, and more particular to an electronic target utilizing a MEMS (Micro Electro Mechanical Systems) sensor.

(b) Description of the Prior Art

The most important thing for operating a firearm is accuracy, whether it is for military or recreation purpose, and accuracy relies on constant training. Therefore, many shooting training systems, especially those integrating laser, photoelectric, and computerized parts, are developed.

The core of a shooting training system is the electronic targets. The volume of electronic targets affects where they be fixed to a target, and the weight affects the types of targets (i.e., fixed target or dangling target) they may be applied to. The detection quality of the electronic targets affects how accurate the shooting practice is measured. The durability and power consumption of the electronic targets are directly linked to their operation cost.

The above-mentioned factors of the electronic targets, i.e., their volume, weight, detection quality, durability, and power consumption, are highly related to the sensors adopted by the electronic targets, in addition to the material used to make the electronic targets. However, conventional sensors for the electronic targets have the following disadvantages.

First, conventional sensors for electronic targets, such as laser sensors, light sensors, piezoelectric sensors, acoustic sensors, vibration sensor, gravity sensors, potential difference sensors, etc., are difficult to install, with their sizable weight and volume.

Second, conventional high-end sensors are costly, especially considering that a large number of them are often required and they are highly consumable under constant impact.

SUMMARY OF THE INVENTION

A major objective of the present invention is to integrate a MEMS (Micro Electro Mechanical Systems) sensor with an electronic target. Due to the MEMS sensor element's small dimension, light weight, low power consumption, high durability, low cost, and stable performance, it can be integrated into the electronic target easily, and the electronic target can be installed more conveniently, quickly, and with lower cost.

To achieve the objective, the electronic target includes a front plate, a chamber behind the front plate, a MEMS sensor element inside the chamber joined to the front plate by at least a connection element, a main control device electrically connected to the MEMS sensor element, and a signal processing element electrically connected to the MEMS sensor element and the main control device.

With the small volume of the MEMS sensor element, it can be conveniently housed in a chamber behind the front plate and connected to the front plate by a connection element. Together with the MEMS sensor element's light weight, it can be fitted to front plates of various types. The signal processing element amplifies the signal produced by the MEMS sensor element, and the main control device configures the response modes of the MEMS sensor element. Due to the MEMS sensor element's low power consumption, high durability, low cost, and stable performance, the electronic target has the advantages of power saving, low installation cost, and superior detection performance.

Through the above design, the present invention obviates the shortcomings of conventional electronic targets that cannot simultaneously resolve the issues of volume, weight, detection quality, durability, power consumption, and installation cost.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
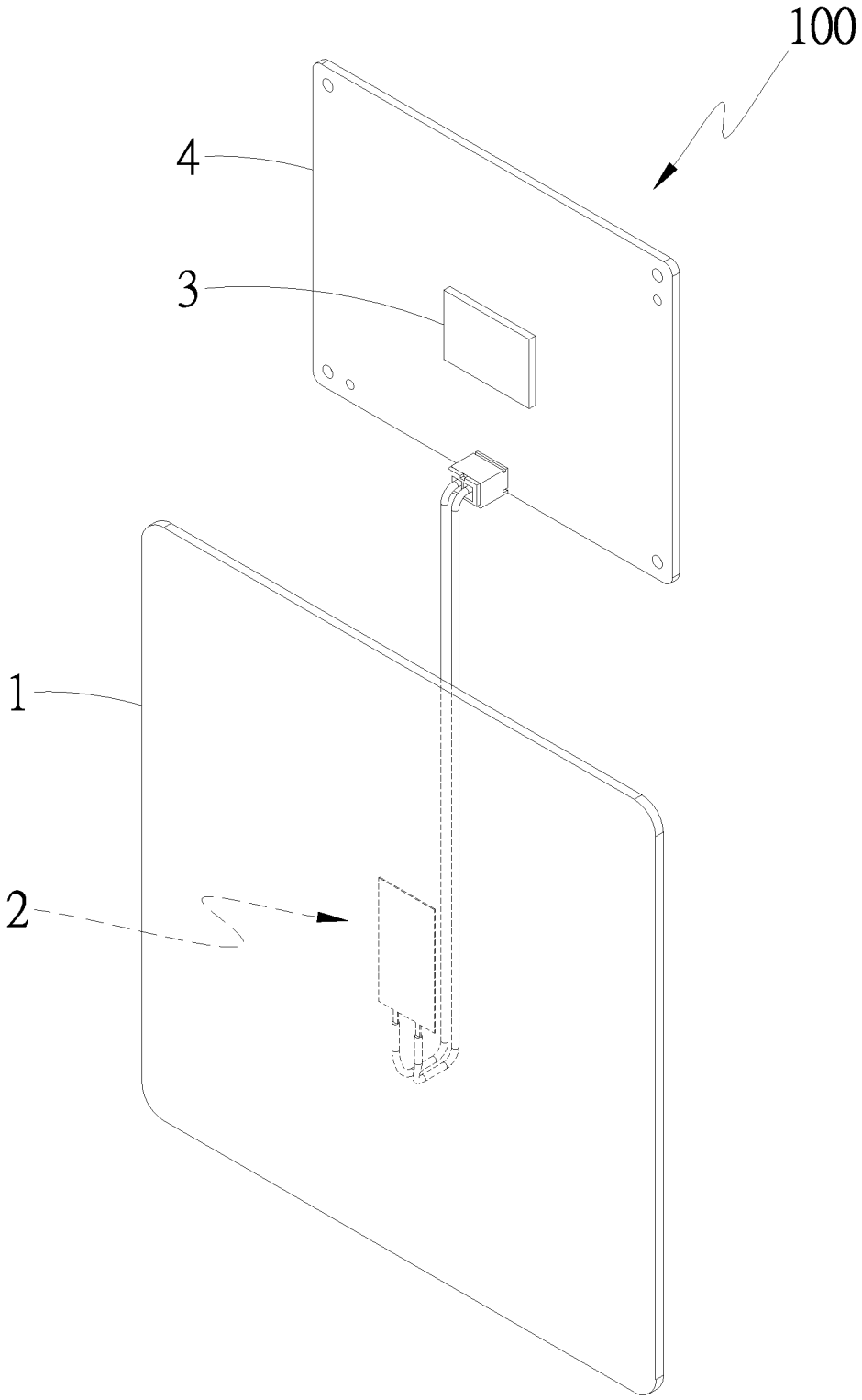
FIG. 1 is a perspective diagram showing an electronic target according to a first embodiment of the present invention.
Figure 2:
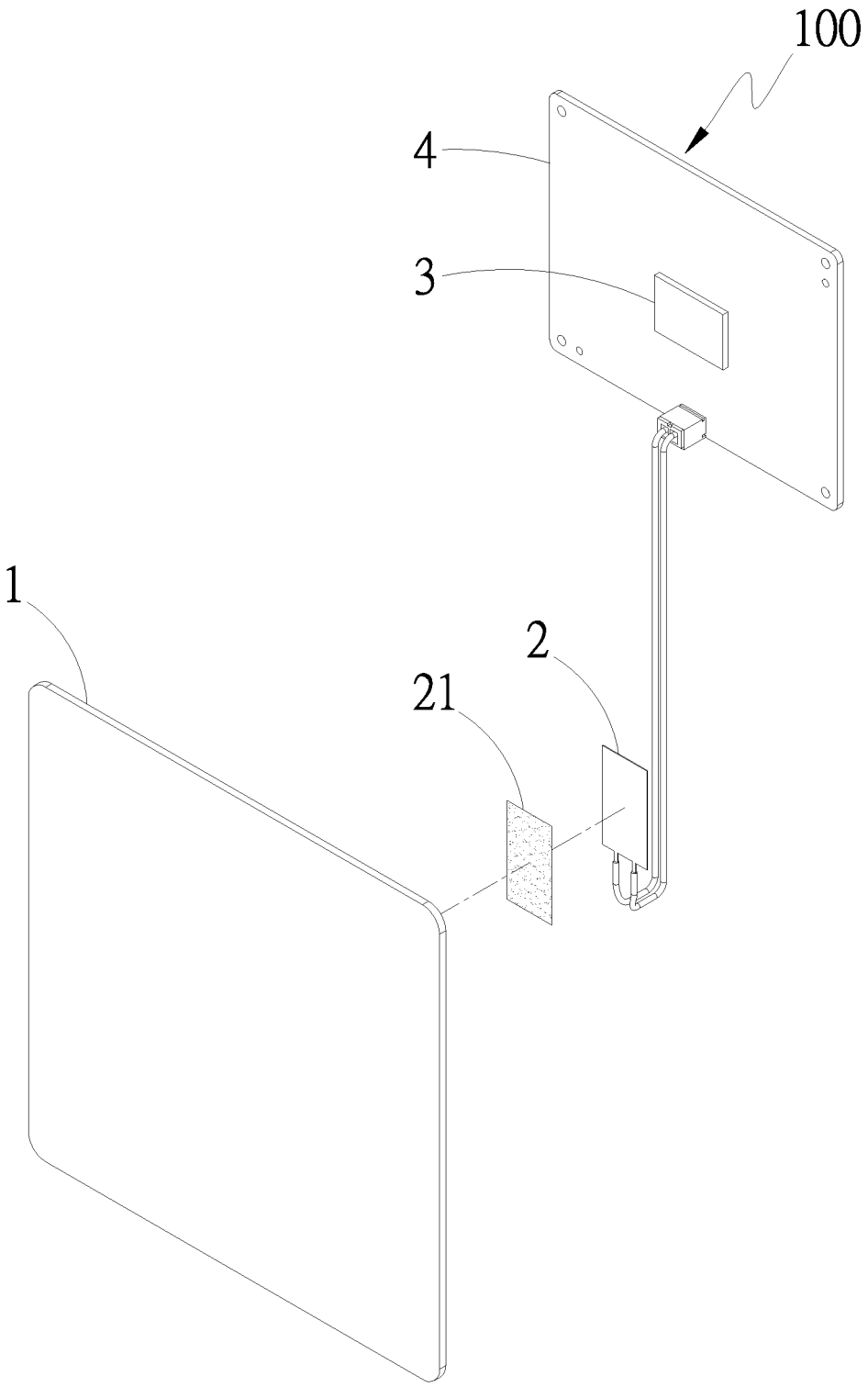
FIG. 2 is a perspective break-down diagram showing the electronic target of FIG. 1.
Figure 3:
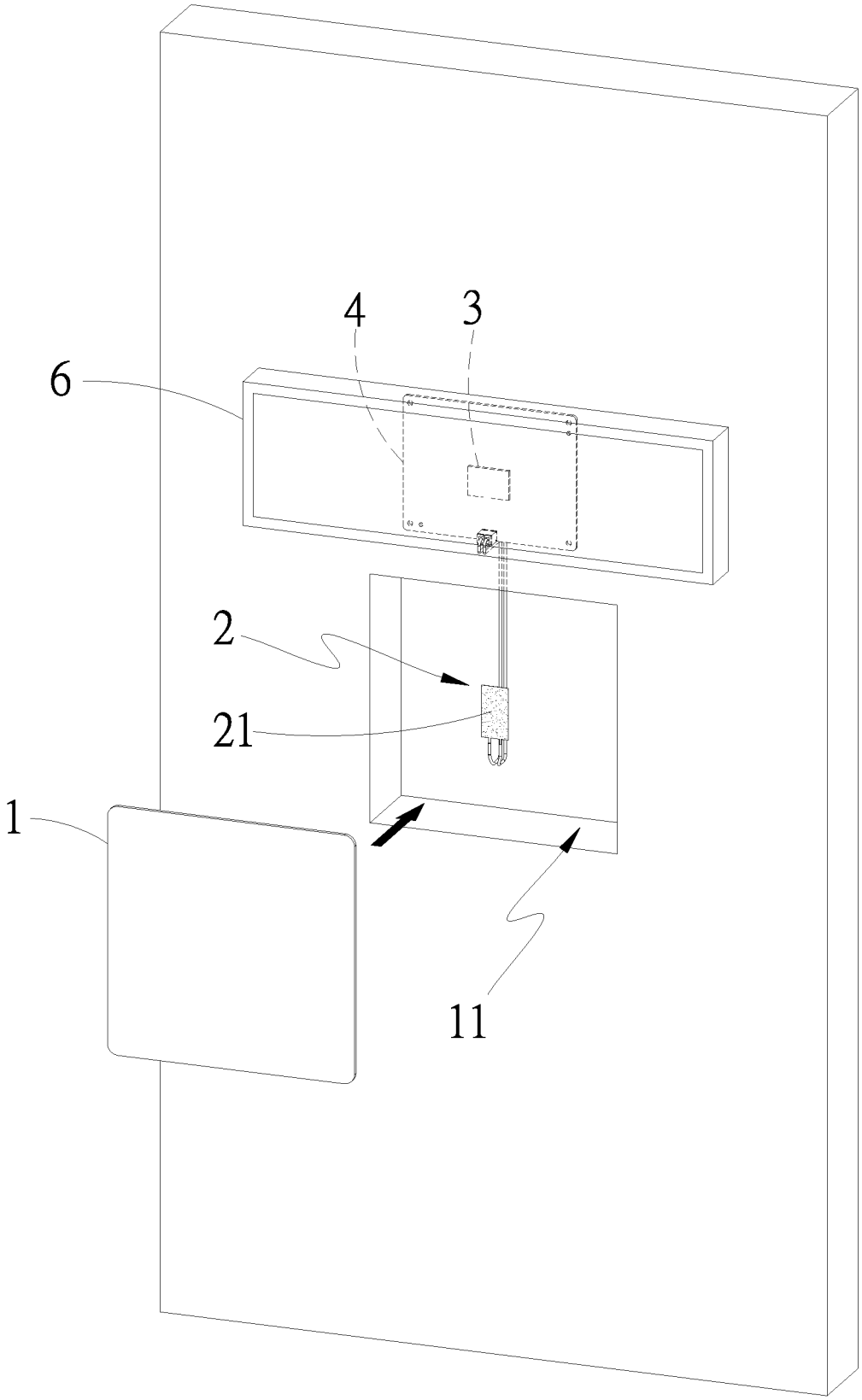
FIG. 3 is a perspective diagram showing an application of the electronic target of FIG. 1.

As shown in FIGS. 1 to 3, an electronic target 100 according to a first embodiment of the present invention includes:

a front plate 1;

a chamber 11 provided behind aback side of the front plate 1;

a MEMS (Micro Electro Mechanical Systems) sensor element 2 positioned inside the chamber 11 and attached to the back side of the front plate 1 by at least a connection element 21;

a main control device 4 electrically connected to the MEMS sensor element 2; and a signal processing element 3 electrically connected to the MEMS sensor element 2 and the main control device 4.

The connection element 21 attaches the MEMS sensor element 2 to the front plate through adhesion or plugging-in. The MEMS sensor element 2 is a MEMS vibration sensor, MEMS air-pressure sensor, or MEMS light sensor. A MEMS vibration sensor is adopted in the present embodiment.

According to the structure of the present invention described above, the present invention provides convenient and fast installation, lower cost, reliable performance, and energy saving. The MEMS sensor element 2 is a micrometer-level 3D device for detecting motion and performing task. It is capable of processing electronic signal and conducting mechanical operation as well. It is an integration of mechanical and electronic elements together on a silicon chip. It may contain up to hundreds or thousands mechanical elements, thereby effective reducing production cost. The production of the MEMS sensor element 2 may be achieved using mature semiconductor materials and techniques such as lithography, etching, etc. With enhanced process precision, these mechanical elements are effectively miniaturized. The MEMS sensor element 2 also relies on capacitive sensing, which offers lower power consumption, better noise reduction, and low temperature coefficient. The MEMS sensor element 2 therefore enjoys superior power consumption rate, durability, and reliability.

The MEMS sensor element 2 is positioned inside the chamber 11 behind the front plate 1 and joined to the front plate 1 through the connection element 21. In the present embodiment, the connection element 21 is an adhesive sheet and the light-weighted MEMS sensor element 2 can be easily adhered to the front plate 1. In the present embodiment, the front plate 1 is fixed to a concave on a wall face and the concave provides the chamber 11, where the MEMS sensor element 2 is positioned. The signal processing element 3 amplifies the signal from the MEMS sensor element 2, and the main control device 4 configures the response mode of the MEMS sensor element 2. For example, in the present embodiment, the signal processing element 3 is an amplifier, and the MEMS sensor element 2 is integrated with the main control device 4 and configured to produce a signal when an impact is sensed so that a score can be tracked. The main control device 4 is a circuit board integrated with a scoreboard device 6. When the front plate 1 is fired upon, the MEMS sensor element 2 can detect whether there is a hit by detecting the presence of resonance wave, or determine the relative distance between the hit location and the center of the target by measuring the strength of the resonance wave. Due to the low power consumption, high durability, low cost, and stable performance of the MEMS sensor element 2, the electronic target 100 therefore enjoys advantages such as power saving, high robustness, inexpensive installation, and accurate detection.

Figure 4:
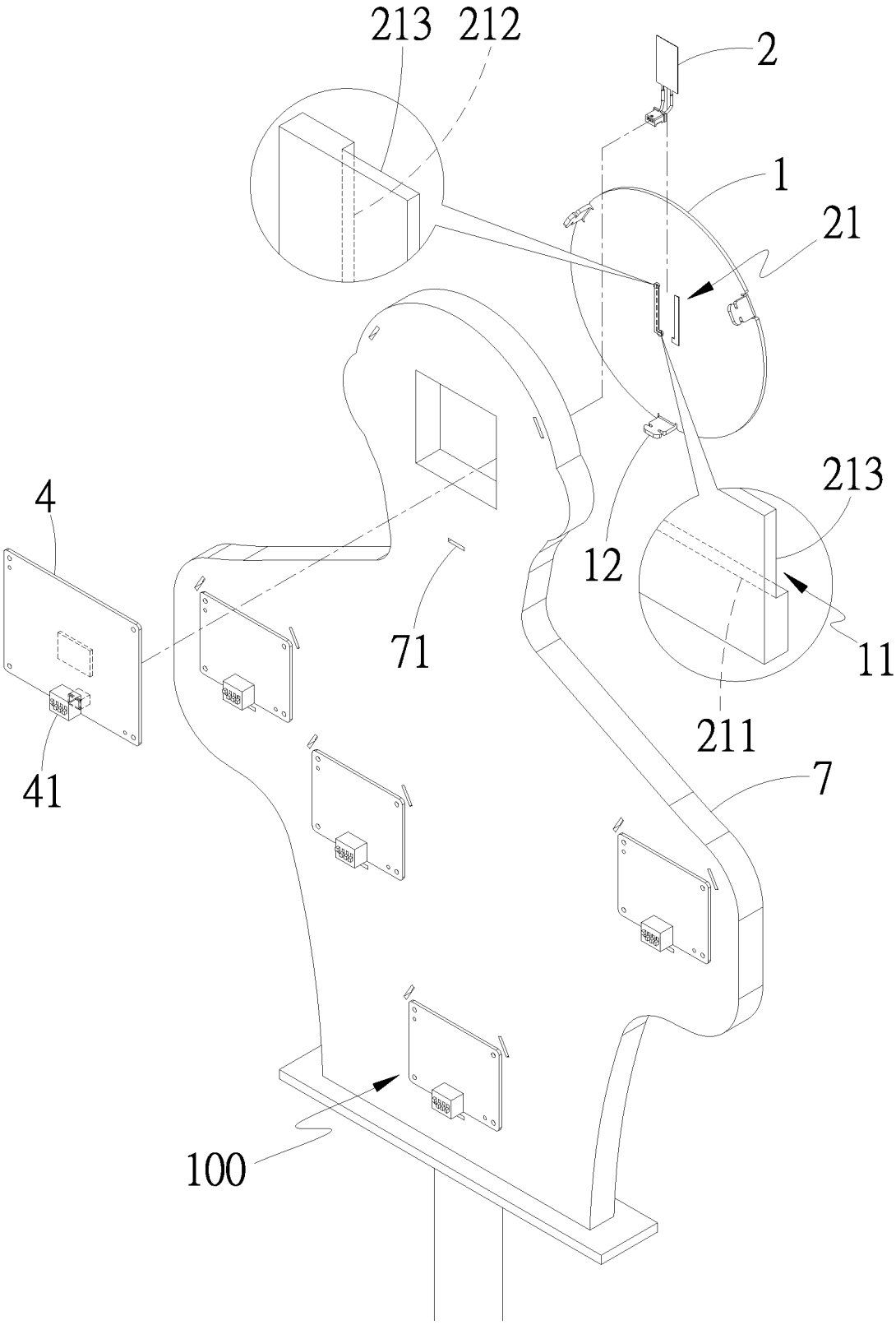
FIG. 4 is a perspective diagram showing an electronic target according to a second embodiment of the present invention.
Figure 5:
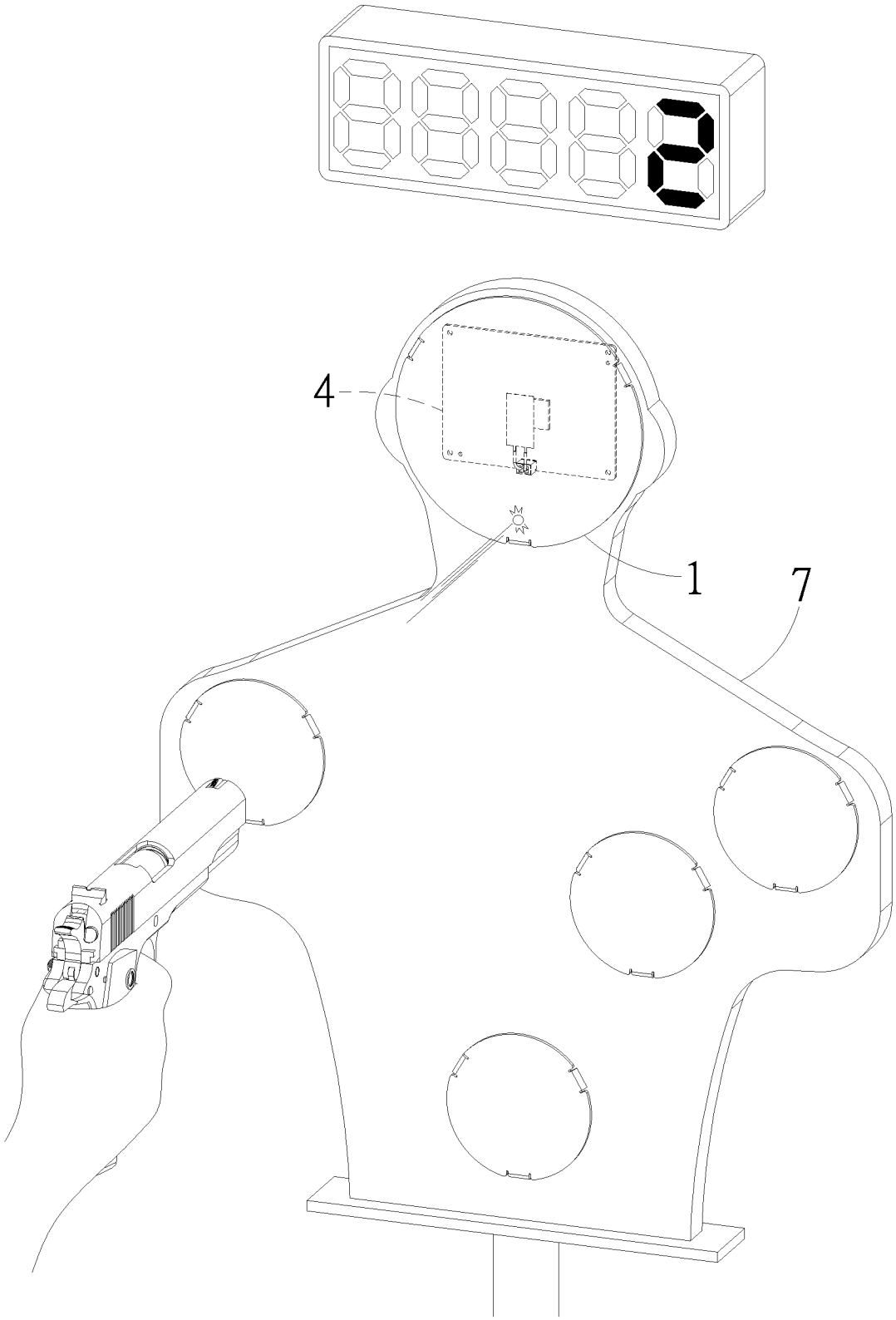
FIG. 5 is a perspective diagram showing an application of the electronic target of FIG. 4.

A second embodiment of the present invention is shown in FIGS. 4 and 5, where multiple electronic targets 100 are applied to various locations on a dummy 7, such as at the dummy 7's head, heart, torso, and limbs. Each main control device 4 is electrically connected to a setting switch 4 so that it may be configured to produce a different signal when a hit is detected. As such, a hit to the dummy 7's head, heart, torso, or limb would produce a different score.

In the present embodiment, the front plate 1 has multiple fasteners 12, which are pieces extended backward from an outer rim of the front plate 1, where each fastener 12 may run through a corresponding opening 71 on the dummy 7. Then, the fasteners 12 may be bended to fix the front plate 1 to the dummy 7. Alternative, the fasteners 12 may have a mushroom shape to plug into the openings 71. In this manner, the front plate 1 can be conveniently installed and replaced. In the present embodiment, each MEMS sensor element 2 is a MEMS air-pressure sensor, which has a thin film on the surface where outside pressure change can be reflected and detected in the inside of the MEMS sensor element 2. As such, an impact on a flexible front plate 1 can be detected. The connection element 21 of each MEMS sensor element 2, in the present embodiment, is a socket on the back side of each front plate 1 formed by two L-shaped structures, positioned laterally and symmetrically. Each L-shaped structure includes a lateral support segment 211 and a vertical limiting segment 212 end-to-end and perpendicularly joined together. A front piece 213 joins to the support segment 211 and the limiting segment 212. The chamber 11 is jointly formed by the support segments 211, the limiting segments 212, and the front pieces 213. The support segments 211 support the MEMS sensor element 2 from below to prevent it from falling. The limiting segments 212 limit the MEMS sensor element 2 from its left and right sides to prevent it from tilting. The front pieces 213 and the front plate 1 limit the MEMS sensor element 2 from its front and back sides so that the MEMS sensor element 2 is reliably attached to the front plate 1 to enhance detection reliability. This plugging type of integration between the MEMS sensor element 2 and the front plate 1 not only is convenient but also enhances reliability, especially suitable for outdoor ranges.

Figure 6:
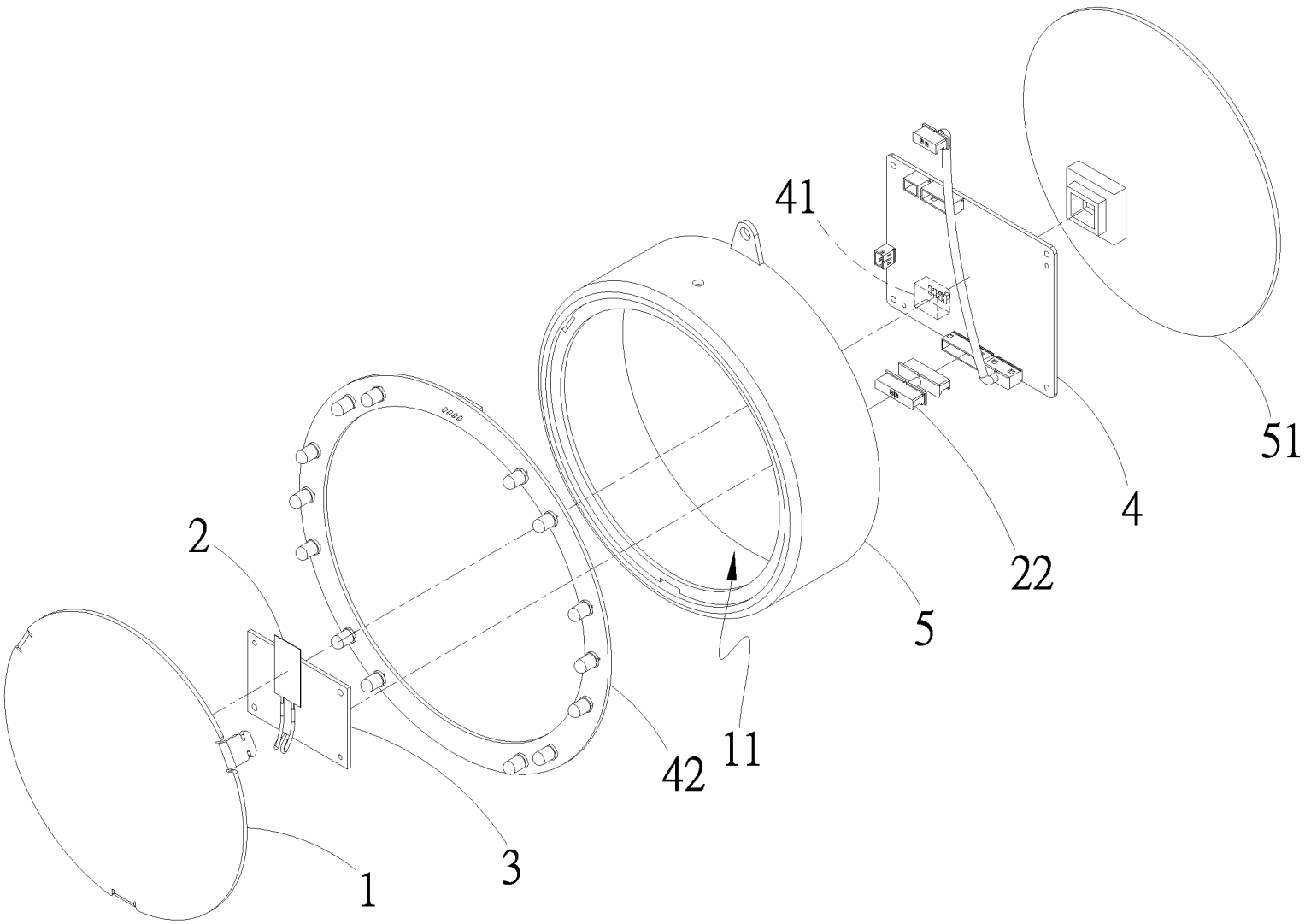
FIG. 6 is a perspective break-down diagram showing an electronic target according to a third embodiment of the present invention.
Figure 7:
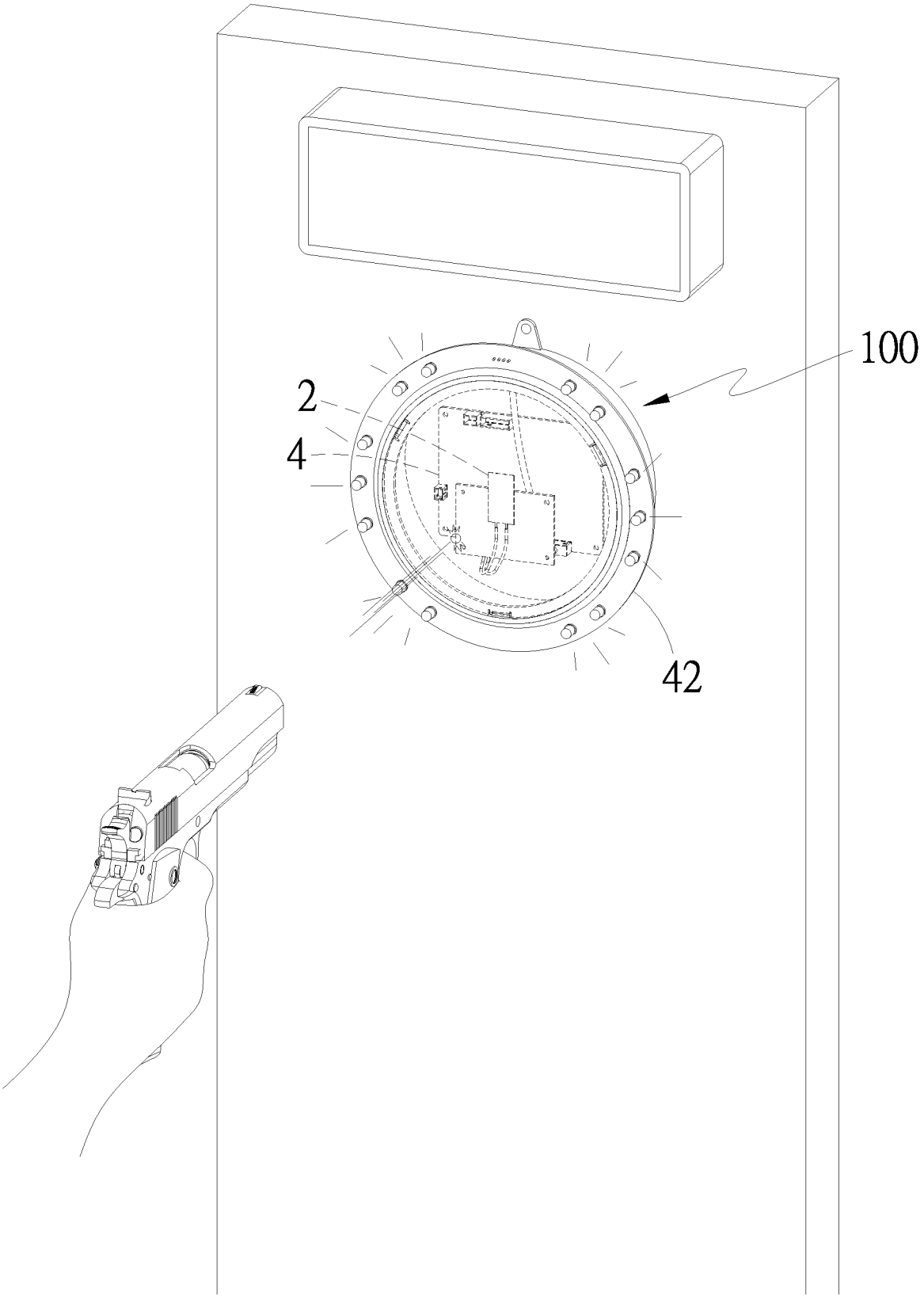
FIG. 7 is a perspective diagram showing an application of the electronic target of FIG. 6.

A third embodiment of the present invention is shown in FIGS. 6 and 7. As illustrated, the present embodiment further includes an indicator 42 electrically connected to the main control device 4, and a casing 5 where the front plate 1 is fitted to seal a front side of the casing 5 and a back plate 51 covers a back side of the casing 5. The chamber 11 is formed inside the casing 5. In the present embodiment, the main control device 4 and the signal processing element 3 are implemented as separate circuit boards so as to emphasize that the main control device 4 and the signal processing element 3 may be electrically connected together in various manners. In the present embodiment, this is achieved by electrical connectors 22 to form board-to-board connection. The MEMS sensor element 2 and the signal processing element 3 are also connected through similar electrical connectors 22 in a wire-to-board manner. As such, the assembly of the electronic target 100 can be more convenient. The setting switch 41 is exposed outside the back plate 51 of the casing 5 for convenient configuration. The indicator 42 may provide audible or lighting indication but is not limited as such. The MEMS sensor element 2 may be configured through the setting switch 41 so that, when a hit is detected, a signal is sent to the main control device 4, and the main control device 4 engages the indicator 42 to provide audible or lighting indication. As the electronic target 100 is sealed in the casing 5, the installation of the electronic target 100 is simplified (e.g., directly hung on a wall), and the internal components of the electronic target 100 is prevented from exposure and becoming damp. In the present embodiment, the MEMS sensor element 2 is a MEMS light sensor and the front plate 1 is made of a translucent material. The MEMS sensor element 2 detects light changes caused by a bullet hitting the front plate 1 and determines the hit location.

Figure 8:
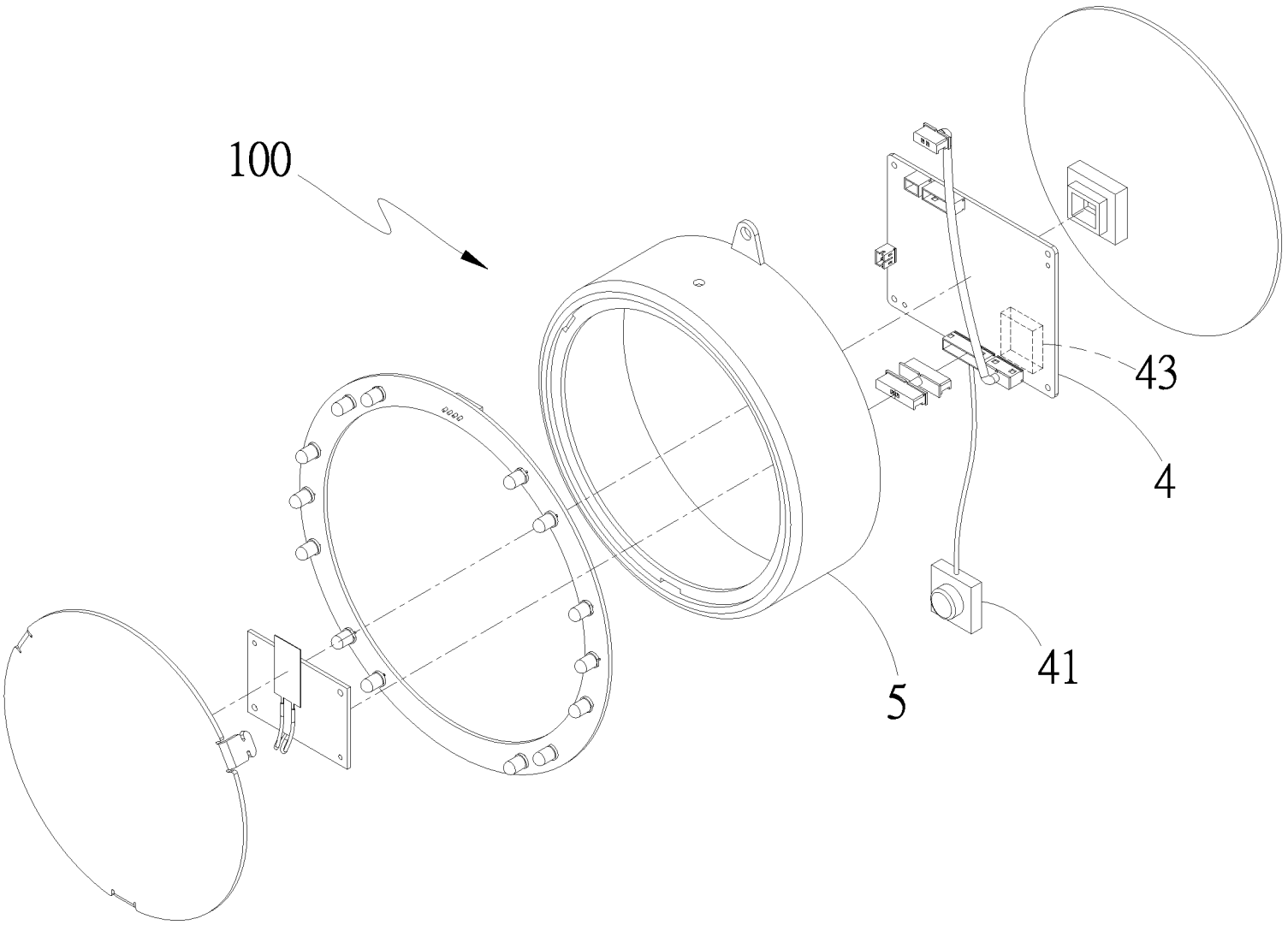
FIG. 8 is a perspective break-down diagram showing an electronic target according to a fourth embodiment of the present invention.
Figure 9:
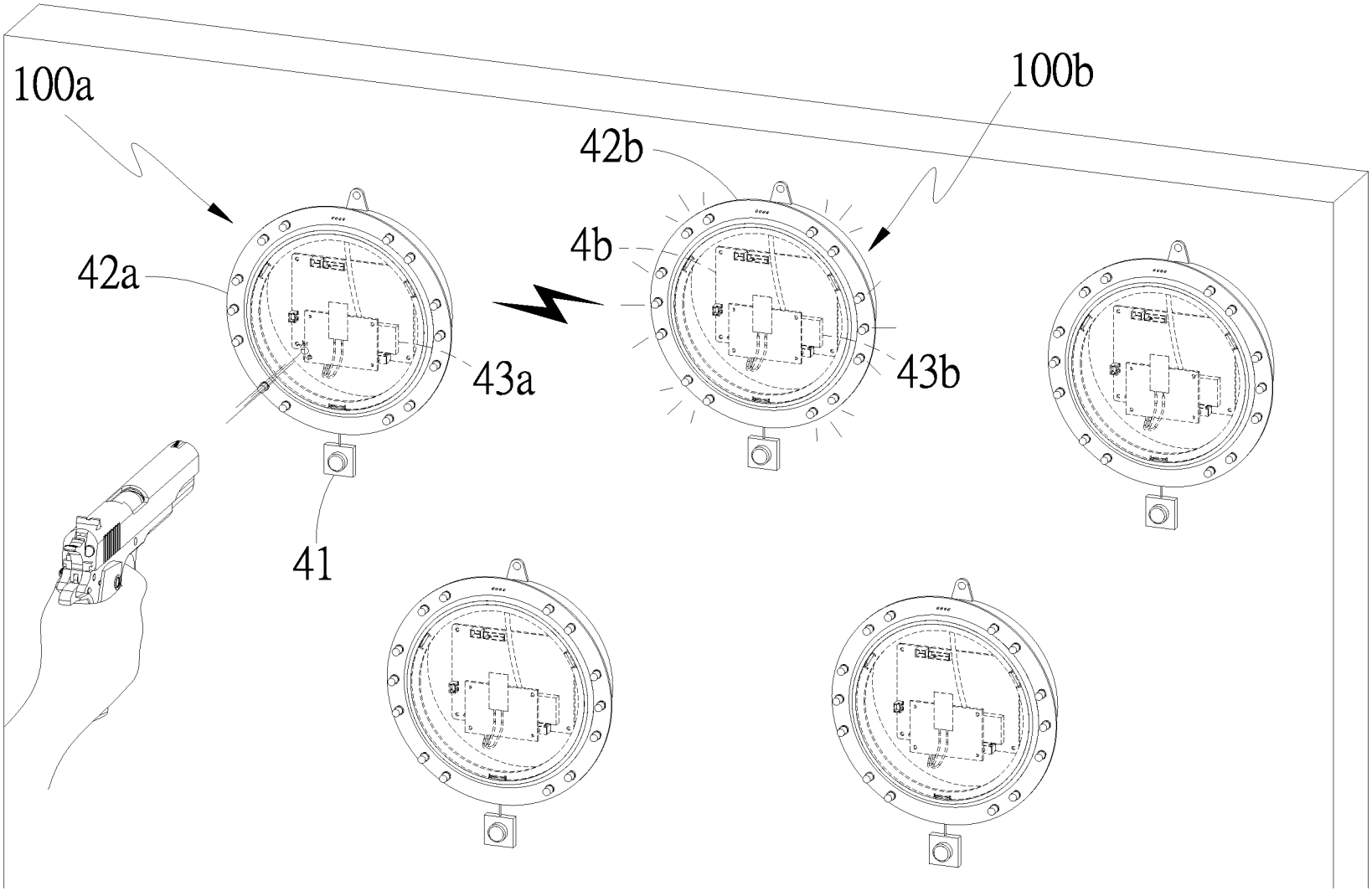
FIG. 9 is a perspective diagram showing an application of the electronic target of FIG. 8.

A fourth embodiment of the present invention is shown in FIGS. 8 and 9. As illustrated, when there are multiple electronic targets 100, each main control device 4 further includes a connector 43 for connecting the main control devices 4 together. In addition, the setting switch 41 in the present embodiment is in the form of a button extended outside the casing 5 wire-connected to the main control device 4 to facilitate user configuration. For example, an indicator 42 may operates differently based on how many times the corresponding setting switch 41 is depressed. Together with the setting switches 41 and the connectors 43, the multiple electronic targets 100, as shown in FIG. 9, can operate jointly to guide the shooter. For example, a first electronic target 100*a*'s indicator 42*a* is set to be the only one providing indication to signal that it is the first target to shoot. Once it is hit, its indicator 42*a* is turned off and a signal is transmitted from the first electronic target 100*a* to a second electronic target 100*b* via the connector 43*a* Once the second electronic target 100*b* receive the signal from its connector 43*b*, its main control device 4*b* activates its indicator 42*b*, signaling that it is now the target to shoot. In the example shown in FIG. 9, the indicator 42*a* of the first electronic target 100*a* is set to provide audible indication, and the indicator 42*b* of the second electronic target 100*b* is set to provide lighting indication.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. An electronic target system comprising a plurality of electronic targets, each electronic target of the plurality of electronic targets comprising:

a front plate;

a chamber provided behind a back side of the front plate;

a MEMS (Micro Electro Mechanical Systems) sensor element positioned inside the chamber and joined to the back side of the front plate by at least one connection element, wherein the at least one connection element joins the MEMS sensor element and the front plate by adhesion or plugging-in;

a main control device electrically connected to the MEMS sensor element, wherein the main control device comprises a connector; and a signal processing element electrically connected to the MEMS sensor element and the main control device, wherein the main control device of said each electronic target is connected through the connector to the connector of the main control device of a remaining one electronic target of the plurality of electronic targets such that a signal is transmittable from the main control device of said each electronic target to the main control device of said remaining one electronic target through the connectors.

2. The electronic target system according to claim 1, further comprising an indicator electrically connected to the main control device.

3. The electronic target system according to claim 1, wherein the front plate has a plurality of fasteners.

4. The electronic target system according to claim 1, further comprising a setting switch electrically connected to the main control device.

5. The electronic target system according to claim 1, further comprising a casing, where the front plate covers a front side of the casing, and the chamber is formed inside the casing.

6. The electronic target system according to claim 1, wherein the at least one connection element comprises at least one support segment, at least one limiting segment perpendicularly end-to-end joined to the at least one support segment, and at least one front piece joined to the at least one support segment and the least one limiting segment; and the chamber is jointly formed by the at least one support segment, at least one limiting segment, and at least one front piece.

* * * * *